US006378227B1

(12) United States Patent
Bradford

(10) Patent No.: US 6,378,227 B1
(45) Date of Patent: Apr. 30, 2002

(54) DRYER VENT EXHAUST ADAPTER DEVICE

(76) Inventor: Danny E. Bradford, 4790 Davis La., Crestview, FL (US) 32539-6311

( * ) Notice: Subject to any disclaimer, the term of this patent is extended or adjusted under 35 U.S.C. 154(b) by 0 days.

(21) Appl. No.: 09/514,259

(22) Filed: Feb. 28, 2000

(51) Int. Cl.[7] ..... F26B 25/06; F24F 7/00
(52) U.S. Cl. ..... 34/235; 454/359
(58) Field of Search ..... 454/359, 353; 34/235, 595

(56) References Cited

U.S. PATENT DOCUMENTS 4,214,380 A 7/1980 Meyer
4,498,624 A * 2/1985 Kogut ..... 237/53
4,967,490 A 11/1990 Berger et al.
5,383,816 A * 1/1995 Marcello et al. ..... 454/359
5,394,663 A * 3/1995 Jackson ..... 52/199
5,482,507 A 1/1996 Priest
5,547,422 A 8/1996 Seboldt
5,568,947 A 10/1996 Paquette
5,590,477 A 1/1997 Carfagno, Sr.
5,662,522 A * 9/1997 Waltz ..... 454/359
5,722,181 A 3/1998 Meyer
5,916,023 A 6/1999 Meyer

* cited by examiner

*Primary Examiner*—Denise L. Esquivel
*Assistant Examiner*—Greg T Warder
(74) *Attorney, Agent, or Firm*—Paul D. Amrozowicz, Esq.

(57) ABSTRACT

An adapter for clothes dryer exhaust vents includes an adapter that fits around a PVC conduit, when such a conduit is used to route dryer vent exhaust from a clothes dryer to the outside of a home or building. The adapter allows much easier installation of a dryer vent when PVC conduit is used. An inverted dryer plenum for a clothes dryer exhaust vent is also disclosed. This inverted dryer plenum is used with an adapter device that may be sized to fit any type of conduit.

10 Claims, 9 Drawing Sheets

DRYER VENT EXHAUST ADAPTER DEVICE

BACKGROUND OF THE INVENTION

1. Field of the Invention

The present invention relates to an adapter for circulating air exhaust vents. Specifically, the present invention relates to an adapter for clothes dryer exhaust vents. More particularly, the present invention relates to an adapter that fits around conventional polyvinylchloride (PVC) conduit, when such conduit is used to route dryer vent exhaust from a clothes dryer to the outside of a home or any other building that houses a dryer. The present invention also particularly relates to an inverted dryer vent plenum for a clothes dryer exhaust vent.

2. Description of Related Art

Clothes dryers exhaust hot air from a vent that is typically arranged in a rear portion of the dryer assembly. The hot air is routed from the dryer vent to the outside of a home or other building via a flexible, or non-flexible conduit. This conduit then runs through an opening in the building and is terminated, external to the building, with an exhaust vent adapter. Such an exhaust vent adapter will include a flapper that serves to prevent fluid backflow, as well as intrusion by small animals. An exhaust vent cover may then be installed over the exhaust vent adapter. This cover directs the flow of exhaust air downward, and also provides a pleasing aesthetic appearance.

One example of such a conventional device is disclosed in U.S. Pat. No. 5,722,181. This device fits either around or within an exit conduit tube and includes overlapping, snap-in louvers to prevent reverse air flow. A snap-fit guard is also provided which includes a lower cage portion. This lower cage portion allows exhaust air to flow outwardly, while preventing the ingress of small birds and animals.

Each of the above-described conventional devices is sized to fit around (or within) conventional dryer exhaust tubing. This tubing is typically manufactured of thin aluminum, and has a nominal diameter of four inches. This is because, conventionally, housing manufacturers have either not provided homes with dryer exhaust vents (leaving such provision to the homeowner), or have merely provided provision for connection of the dryer to this conventional type of tubing.

More recently, however, housing manufacturers have begun "hard-piping" dryer vent exhaust piping into new homes using PVC conduit. For example, as shown in FIG. 12, the housing manufacturer may run the conduit 92 from the dryer's proposed location (not shown), under the slab (or foundation) 94, through the exterior wall 96, to the outside. The housing manufacturer may then install a conventional dryer exhaust vent 98, such as one of those described above. These conventional devices are, however, not designed to fit within or around conventional PVC conduit. Thus, before one of these devices can be installed in conjunction with a PVC conduit, the conduit must first be chiseled out an inch or more to accommodate the conventional device. This installation is difficult and time consuming, taking upwards of one-half to three-quarters of an hour.

SUMMARY OF THE PRESENT INVENTION

It is therefore a principal object of the present invention to provide an adapter that will allow installation of a dryer vent over a PVC conduit, without having to chisel out a portion of the conduit.

It is also an object of the present invention to provide a novel inverted dryer vent plenum that will allow installation of a dryer vent over conventional dryer exhaust tubing or a PVC conduit.

In a first aspect of the present invention an exhaust vent adapter for controlling the flow of air from a structure comprises a frame and a tubular structure. The frame has first and second sides, and a substantially circular opening extending through the frame from the first side to the second side. The tubular structure extends from the second side and surrounds a periphery of the circular opening. The opening is adapted to fit snugly around a PVC conduit.

In another aspect of the present invention, an adapter for the exhaust vent of a clothes dryer interconnected by a PVC conduit comprises a frame and a hinged flapper. The frame includes a substantially circular opening extending through it from a first side to a second side. The opening is dimensioned so as to fit around the PVC conduit. The hinged flapper device rotationally extends from the first side of the frame to cover the opening. The flapper device prevents fluid flow from the first side to the second side, while permitting fluid flow from the second side to the first side.

In yet another aspect of the present invention, a dryer exhaust vent adapter comprises a frame, a tubular structure, at least one hinge, a flow control device, a groove and a cover. The frame has first and second sides and a substantially circular opening extending through it from the first side to the second side. The opening has a periphery sized to fit snugly around a 4-inch PVC conduit. The tubular structure extends from the first side of the frame and surrounds the periphery of the opening. The at least one hinge extends perpendicularly from the first side of the frame. The flow control device suspends from the at least one hinge, such that said flow control device covers the tubular structure. The groove extends around a plurality of outer edges of the frame. The cover has a plurality of extensions that slide into the groove, and the cover substantially covers the first side of the frame and has an opening in a bottom portion thereof.

In yet another aspect of the present invention, an inverted dryer vent plenum assembly comprises a frame, a substantially rectangular cubical plenum member, an intake port, an exhaust port, and a rotationally mounted flapper. The frame has an opening extending therethrough from a first side to a second side. The plenum member is supported on the frame, and has a front wall, a rear wall, at least two side walls, a top wall, and a bottom wall. The intake port is in the rear wall of the plenum member and is dimensioned so as to fit around the opening. The exhaust port is in an upper portion of the front wall of the plenum member. The rotationally mounted flapper is dimensioned so as to cover the exhaust port.

In still a further object of the present invention, an inverted dryer vent plenum assembly comprises a frame, a substantially rectangular cubical plenum member, an intake port, an exhaust port, a rotationally mounted flapper, an exhaust shroud, a plurality of fluid deflectors, a groove, a lip portion, and tongue members. The frame has an opening extending therethrough from a first side to a second side. The plenum member is supported on the frame, and has a front wall, a rear wall, at least two side walls, a top wall, and a bottom wall. The intake port is in the rear wall of the plenum member and is dimensioned so as to fit around the opening. The exhaust port is in an upper portion of the front wall of the plenum member. The flapper is dimensioned so as to cover the exhaust port. The exhaust shroud extends from the top wall of the plenum member and has an opening in a bottom portion thereof. The plurality of fluid deflectors are positioned within the housing. The groove extends around an outer periphery of the first member of the frame. The lip portion extends around an outer periphery of the second member of the frame. The tongue members extend outwardly from the rear wall of the plenum member in a direction perpendicular to the side walls and are inserted in the groove.

DETAILED DESCRIPTION OF THE PREFERRED EMBODIMENTS

Figure 1:
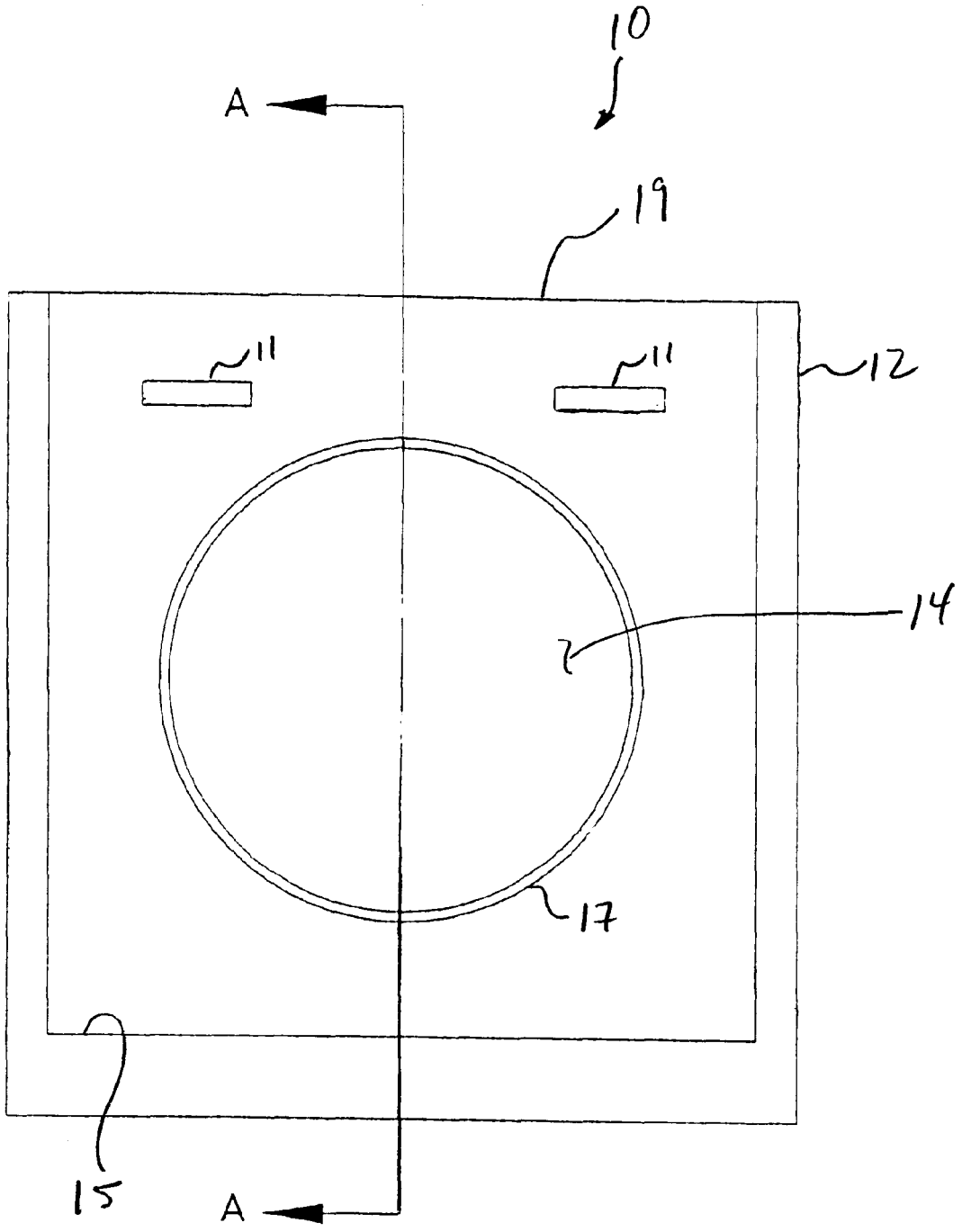
FIG. 1 depicts a front view of the vent exhaust adapter according to a first embodiment of the present invention.
Figure 2:
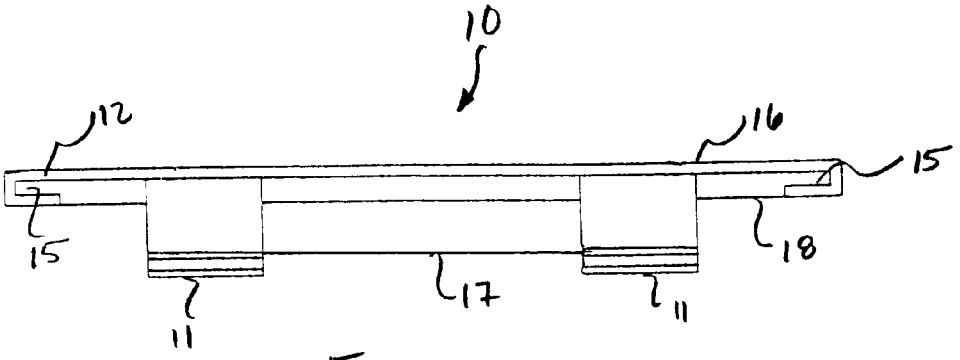
FIG. 2 depicts a top view of the vent exhaust adapter according to a first embodiment of the present invention.
Figure 3:
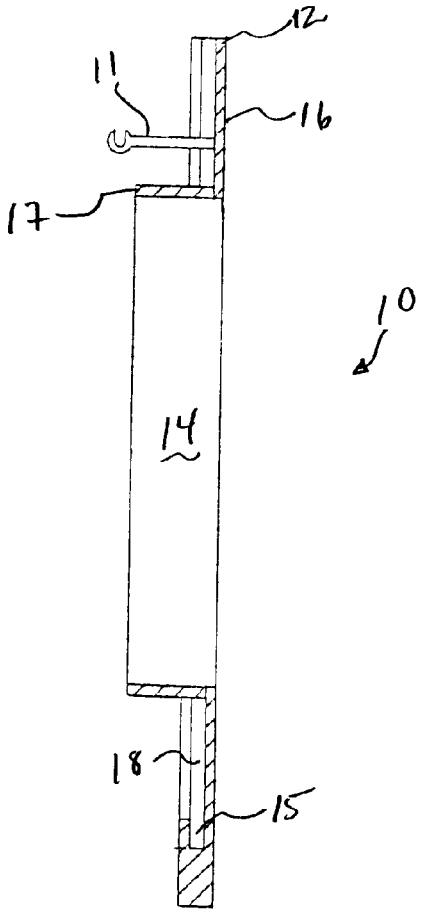
FIG. 3 depicts a section view along the line A—A of FIG. 1.

FIGS. 1, 2 and 3 depict front, side, and section views, respectively, of a first embodiment of the present invention. The adapter 10 includes a frame 12 having an opening 14 that runs through it, from the rear side 16 to the front side 18. The opening 14 could be any shape necessary to fit snugly around the dryer vent conduit, but in the preferred embodiment is cylindrically shaped. Additionally, the circumference of opening 14 is such that it will slide snugly over the outer circumference of a standard 4" PVC conduit. A short tubular structure 17, having substantially the same circumference as opening 14, may be included and positioned to surround opening 14 and extend from the front portion 18 of the frame 12.

Figure 4:
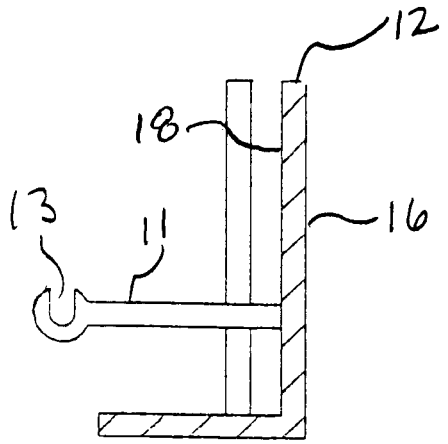
FIG. 4 depicts an exploded view of an example of a hinge device according to a first embodiment of the present invention.

The front portion 18 of frame 12 also includes hinge devices 11 extending perpendicularly therefrom. These hinge devices 11 provide rotational support for a flapper 20 (see FIG. 5), which will be discussed further below. The number of hinge devices 11 used could be any number that the ordinarily skilled artisan believes necessary for the application, but in the preferred embodiment two such hinges 11 are used. As can be seen in FIGS. 3 and 4, each hinge device 11 extends perpendicularly from the frame front portion 18, and includes an opening 13 extending in the upward direction. Each opening 13 is sized to securely capture a flapper rotational extension piece 21, while allowing for rotational movement of the flapper 20. Additionally, as will be apparent to the ordinarily skilled artisan, the disclosed hinge device 11 configuration is not limited by that depicted, but could take on various configurations. For example, the hinge devices could be integral with the sides of the frame, allowing the flapper 20 to be snap-fit into them.

Figure 6A:
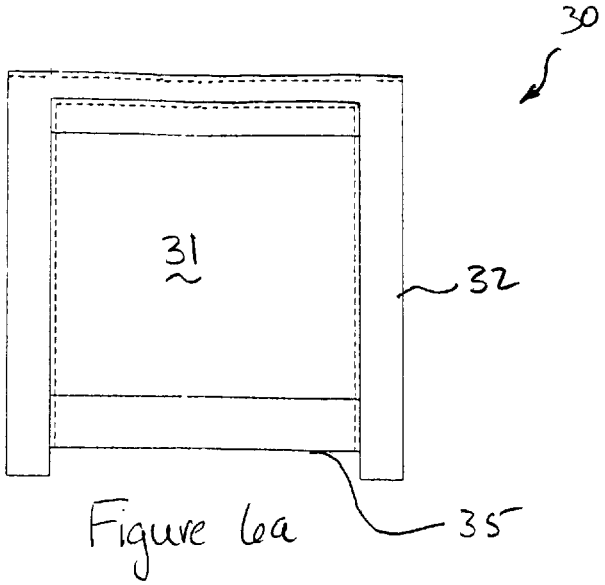
FIGS. 6*a*–6*c* depict front, top, and side views, respectively, of a vent cover according to a first embodiment of the present invention.
Figure 6B:
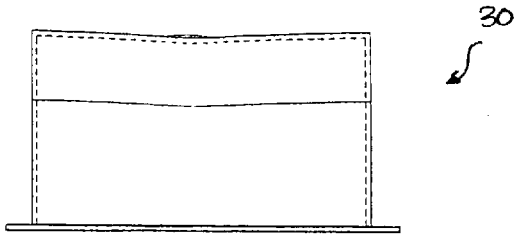
Figure 6C:
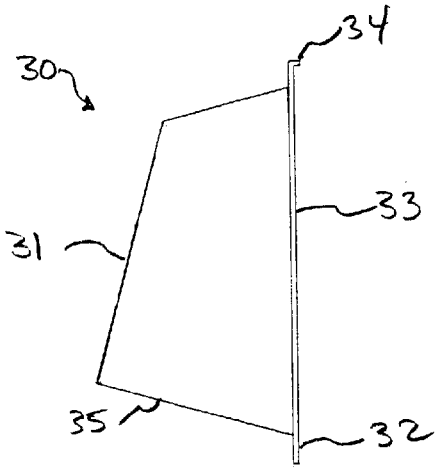

A lip portion 15 extends around the outer periphery of the frame 12 to receive a cover 30 (FIGS. 6*a*–6*c*). The lip portion 15 does not extend around the entire periphery of frame 12, thus, as depicted in FIG. 1, it is not included around a top portion 19 of frame 12. The lip portion 15 provides support for cover 30, which is slid into the lip portion 15 from the top of the frame 12. The lip portion 15 is sized to securely receive the cover 30 and provide structural support therefor. It will be clear to one of ordinary skill that other means could be used to attach and support vent cover 30. Such non-limiting examples include providing lip portions at spaced locations around the periphery of the frame 12, attaching the frame 12 with fasteners or an adhesive, or providing a snap-fit attachment for the cover 30.

Figure 5:
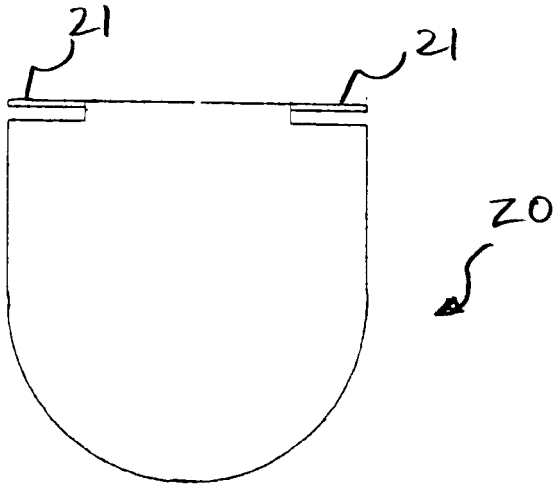
FIG. 5 depicts an example of a flapper device used with the device according to a first embodiment of the present invention.

FIG. 5 depicts a preferred embodiment of a vent flapper 20 for use with the first embodiment of the present invention. The vent flapper 20 has a generally U-shaped circumference and includes two rotational extension pieces 21. The flapper is, of course, not restricted to a U-shape and could be any shape desired by the ordinarily skilled artisan. The rotational extension pieces 21 fit snugly, yet are rotationally supported, in the hinge device openings 13, as discussed above. Again, the extension pieces 21 are not limited to that depicted, but could, for example, extend beyond the outer periphery of the main body of the flapper 20 and be received in snap-fit hinge portions, discussed previously above.

FIGS. 6*a*–6*c* depict front, top, and side views, respectively, of the vent cover 30 according to the first embodiment of the present invention. The vent cover 30 includes a generally hollow deflecting portion 31, that receives air flow into its rear side 33 and deflects the air flow out a lower opening 35. As can be seen, the vent cover includes an extension portion 32 around the outer periphery thereof. This extension portion 32 is sized and dimensioned so as to be slidably, yet snugly, received into the lip portion 15 of frame 12. The vent cover 30 may also include an engagement portion 34 extending rearward from the top of the extension portion 32. The engagement portion 34 will rest on the top 19 of the frame 12 when the vent cover 30 is installed over the frame 12.

Figure 7:
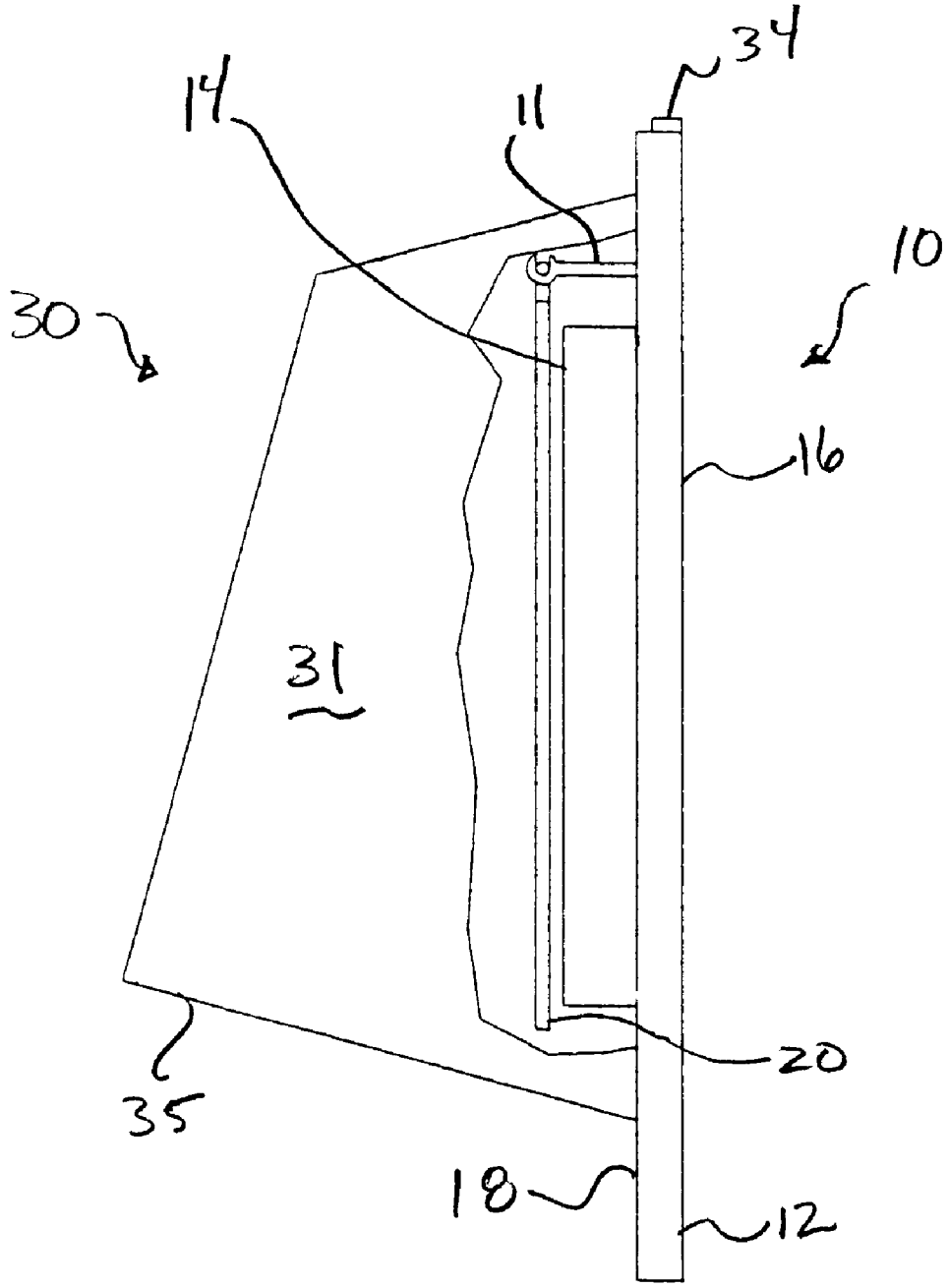
FIG. 7 depicts a side view of an assembled dryer vent, including a partial cut-away section, according to the first embodiment of the present invention

FIG. 7 depicts a side view of an assembled dryer vent, including a partial cut-away section, according to the first embodiment of the present invention. This Figure clearly depicts the adapter 10 snugly, yet rotationally, receiving the flapper 20 in the hinge devices 11. This allows the flapper 20 to hang freely from the hinge devices 11 and completely cover the frame opening 14. The rotational support allows air to flow through the frame 12 in only one direction, while simultaneously preventing small animals from entering the conduit to which it is adapted. FIG. 7 further depicts the vent cover 30 installed over the adapter frame 12. This is accomplished by sliding the cover extension portions 32 into the lip portion 15 of the adapter frame 12. Also depicted is the engagement portion 34 covering the top portion 19 of the adapter frame 12.

FIGS. 8 through 11 depict a second embodiment of the present invention. This second embodiment differs from the first embodiment in shape and form, but is functionally equivalent to the first embodiment.

Figure 8A:
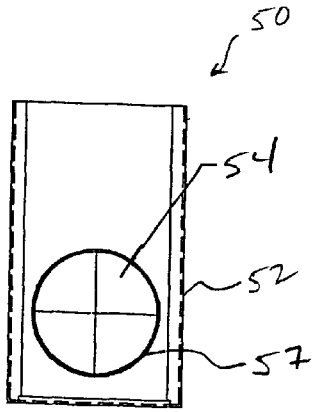
FIGS. 8*a*–8*c* depict front, side, and top views, respectively, of an adapter frame according to a second embodiment of the present invention.
Figure 8B:
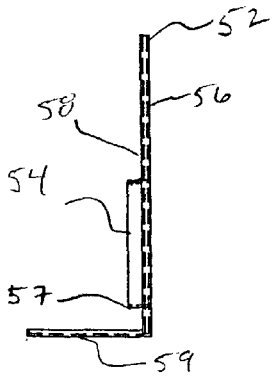
Figure 8C:
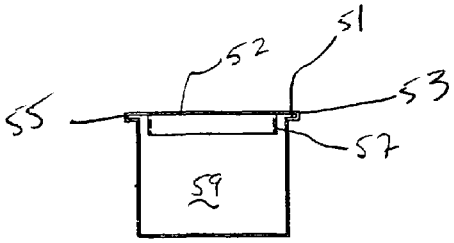

FIGS. 8*a*–8*c* depict an adapter 50 according to a second embodiment of the present invention. The adapter 50 includes a frame 52 that has a substantially L-shaped cross section, though it will be understood that other cross sectional shapes could be used. The frame 52 includes an opening 54 that runs through it, from the rear side 56 to the front side 58. Similar to the first embodiment, the opening 54 could be any shape necessary to fit snugly around the dryer vent conduit, but in the preferred embodiment is cylindrically shaped. Additionally, the circumference of opening 54 in this embodiment can be dimensioned so as to fit around any size conduit, but in the preferred embodiment is sized such that it will slide snugly over the outer circumference of a standard 4" PVC conduit. The opening may also include a short tubular structure 57 extending from the front side 58, to provide additional structural support when installed around a conduit.

As can be seen in FIG. 8*c,* frame 52 includes groove portions 51 on the outer right 53 and left 55 portions of the fame 52. The frame 52 further includes a bottom portion 59 on which an exhaust plenum 60 (FIG. 9) rests when fully installed.

The exhaust plenum 60, depicted in FIGS. 9*a*–9*d,* is a substantially rectangular parallelopiped structure comprising a front wall 62, a rear wall 64, right 66 and left 68 side walls, and top 61 and bottom 63 walls. The exhaust plenum 60 slides into, and is supported by, adapter 50. Extension portions, or tongues, 65 along the outer periphery of the rear wall 64 are received into the groove portions 51 by sliding the exhaust plenum 60 onto the adapter 50 from above. It will, of course, be understood that other means of attaching plenum 60 to adapter 50 could be used, such as screws, rivets, adhesive, etc.

Figure 9A:
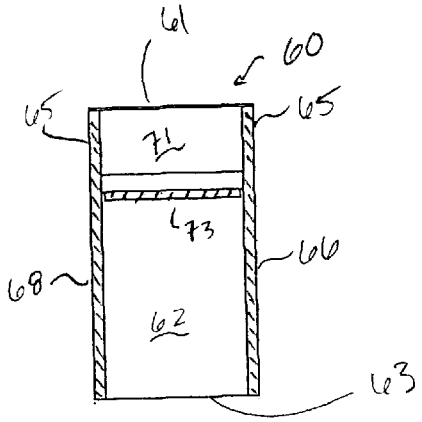
FIGS. 9*a*–9*d* depict front, side, top, and rear views, respectively, of an exhaust plenum according to a second embodiment of the present invention.
Figure 9B:
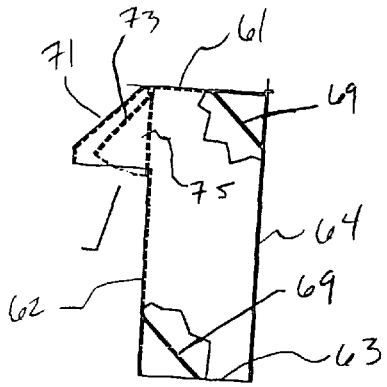
Figure 9C:
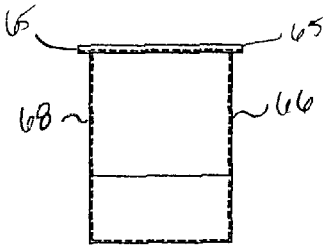
Figure 9D:
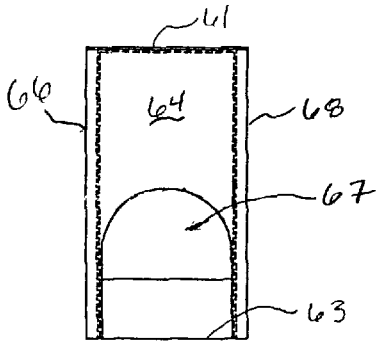

FIG. 9*d* depicts a rear view of plenum 60. As can be seen, rear wall 64 includes an opening 67 that accommodates the tubular structure 57 when the plenum 60 is installed onto the frame 50. This opening 67 is dimensioned so as to fit snugly around the outer periphery of the tubular structure 57. The exhaust plenum 60 also includes a plurality of air deflectors 69. FIG. 9*b* depicts two deflectors 69, though it will be appreciated by the ordinarily skilled artisan that any number could be used. These deflectors 69 serve to efficiently direct the flow of exhaust gas through the plenum 60. Also shown in FIG. 9*b* is a vent shroud 71. The vent shroud 71 provides physical and environmental protection for the vent flap 73 that extends over the plenum outlet 75.

Figure 10:
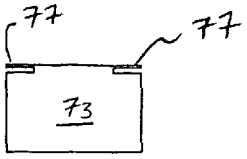
FIG. 10 depicts a flapper device according to a second embodiment of the present invention.
Figure 11A:
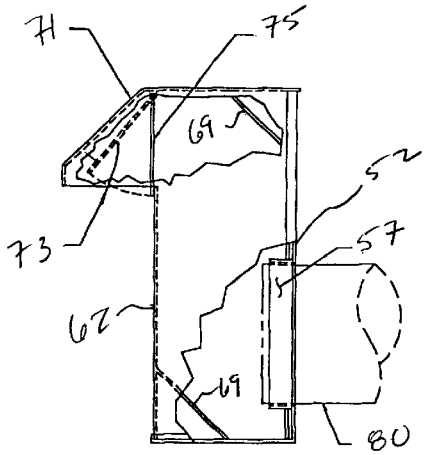
FIGS. 11*a*–11*d* depict side, rear, front, and top views, respectively, of a fully integrated device according to a second embodiment of the present invention.
Figure 11B:
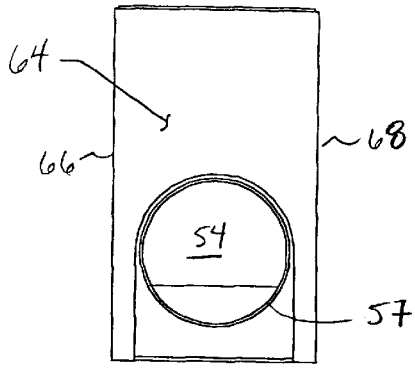
Figure 11C:
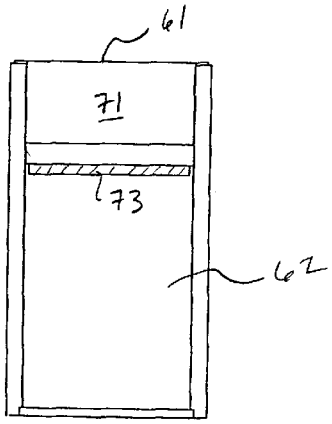
Figure 11D:
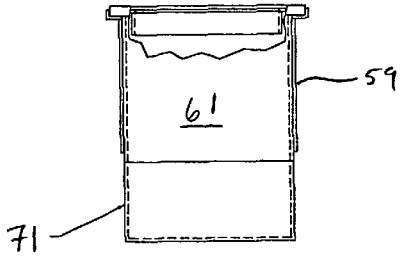
Figure 12:
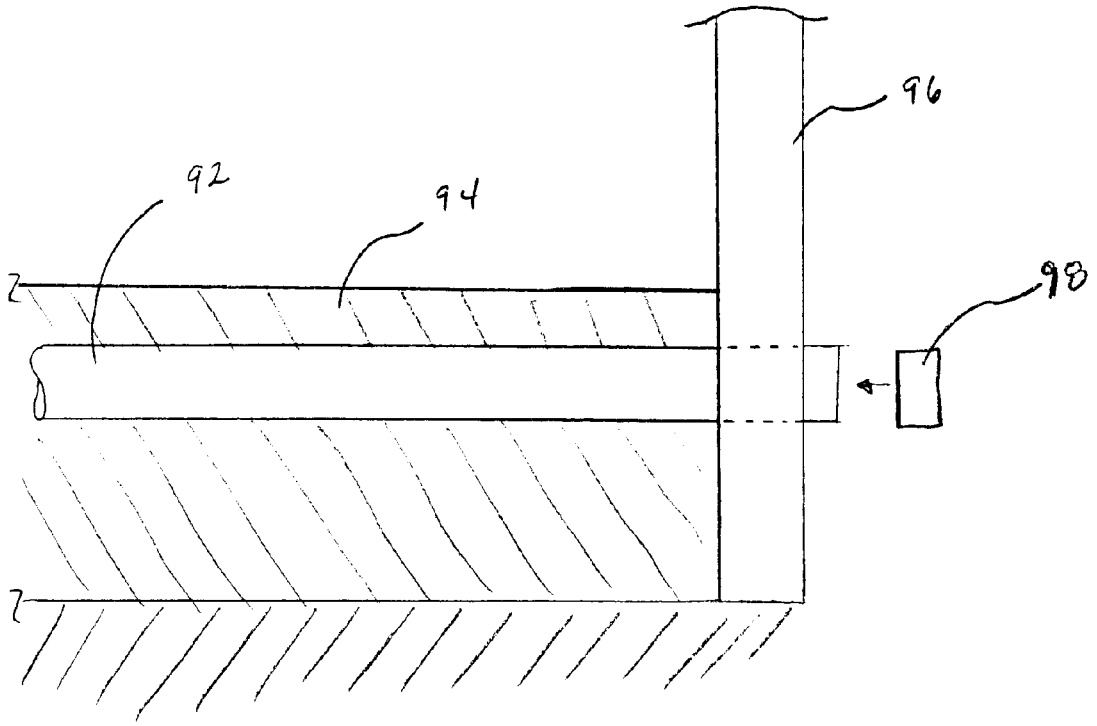
Figure 12 (Prior Art)
FIG. 12 depicts a convention clothes dryer ventilation exhaust arrangement.

Vent flap 73, shown more particularly in FIG. 10, allows exhaust fluid to flow out of plenum 60 through plenum outlet 75, while preventing any flow into plenum 60 through outlet 75. Vent flap 73 can also prevent the ingress of pests and other small animals into the plenum and conduit. Vent flap 73 may be rotationally attached to plenum 60 using any known method known in the art, but in the preferred embodiment is rotationally engaged via extension pins 77 on the upper portion of vent flap 73.

FIGS. 11*a*–11*d* show this second embodiment in its fully installed condition. The adapter 50 is slid onto the exhaust conduit 80 exiting a building structure (not shown). The adapter 50 may then be affixed to the exhaust conduit 80 using adhesive, rivets, screws, or any other device known to the ordinarily skilled artisan. The exhaust plenum 60 is slid into, and supported by, the adapter 50 via the engagement between the tongues 65 and grooves 51. The exhaust plenum 60 bottom wall 63 rests on the frame 52. Any exhaust fluid flowing in conduit 80 enters the plenum 60, is deflected by deflectors 69, and exits exhaust port 75 via flapper 73 and vent shroud 71.

It should be understood that the particular assembly depicted in the Figures and described herein are only illustrative examples of the numerous assemblies that can be formed by an ordinarily skilled artisan practicing the present invention.

While preferred embodiments of the present invention have illustrated in detail, it is apparent that modifications and adaptations of the preferred embodiments will occur to those skilled in the art. However, it will be expressly understood that such modifications and adaptations are within the spirit and scope of the present invention as set forth in the following claims.

I claim:

1. An inverted dryer vent plenum assembly comprising:

a frame including a first member and a second member coupled perpendicularly to said first member, said first member having an opening extending therethrough between a first side and a second side;

a substantially tubular structure extending from said first side and surrounding, and having an inner diameter substantially equivalent to, said opening;

a substantially rectangular cubical plenum member supported on said frame second member, said plenum member having a front wall, a rear wall, at least two side walls, a top wall, and a bottom wall;

an intake port in said rear wall of said plenum member dimensioned so as to fit around at least a portion of said opening;

an exhaust port in an upper portion of said front wall of said plenum member; and a rotationally mounted flapper dimensioned so as to cover said exhaust port.

2. The inverted dryer vent plenum assembly according to claim 1, further comprising:

an exhaust shroud extending from said top wall of said plenum member and having an opening in a bottom portion thereof.

3. The inverted dryer vent plenum assembly according to claim 1, further comprising:

a plurality of fluid deflectors positioned within said plenum member.

4. The inverted dryer vent plenum assembly according to claim 1, wherein said flapper comprises pins extending from a top portion of said flapper, said pins being rotationally supported by hinge members positioned proximate said exhaust port.

5. The inverted dryer vent plenum assembly according to claim 1, further comprising:

a groove extending around an outer periphery of said first member of said frame;

and a lip portion extending around an outer periphery of said second member of said frame; and tongue members extending outwardly from said rear wall of said plenum member in a direction perpendicular to said side walls, said tongue members being inserted in said groove.

6. The inverted dryer plenum assembly according to claim 1, wherein said tubular member is arranged to be inside said plenum member.

7. The inverted dryer plenum assembly according to claim 1, wherein said opening is dimensioned so as to fit snugly around a 4" PVC conduit.

8. An inverted dryer vent plenum assembly comprising:

a frame including a first member and a second member coupled perpendicularly to said first member, said first member having an opening extending therethrough between a first side and a second side;

a substantially tubular structure extending from said first side and surrounding, and having an inner diameter substantially equivalent to, said opening;

a substantially rectangular cubical plenum member supported on said frame second member, said plenum member having a front wall, a rear wall, at least two side walls, a top wall, and a bottom wall;

an intake port in said rear wall of said plenum member dimensioned so as to fit around at least a portion of said opening;

an exhaust port in an upper portion of said front wall of said plenum member;

a rotationally mounted flapper dimensioned so as to cover said exhaust port;

an exhaust shroud extending from said top wall of said plenum member and having an opening in a bottom portion thereof; and a plurality of fluid deflectors positioned within said plenum member.

9. An inverted dryer plenum assembly according to claim 1, wherein said flapper comprises pins extending from a top portion of said flapper, said pins being rotationally supported by hinge members positioned proximate said exhaust port.

10. An inverted dryer plenum assembly according to claim 8, wherein said opening is dimensioned so as to fit snugly around a 4" PVC conduit.

* * * * *